US006889605B1

(12) United States Patent
Natori et al.

(10) Patent No.: US 6,889,605 B1
(45) Date of Patent: May 10, 2005

(54) HEAT-SENSITIVE STENCIL, PROCESS OF FABRICATING SAME AND PRINTER USING SAME

(75) Inventors: Yuji Natori, Numazu (JP); Fumiaki Arai, Mishima (JP); Masanori Rimoto, Mishima (JP); Tetsuo Tanaka, Mishima (JP); Hiroshi Tateishi, Fujinomiya (JP)

(73) Assignees: Ricoh Company, Ltd., Tokyo (JP); Tohoku Ricoh, Co., Ltd., Miyagi-ken (JP)

( * ) Notice: Subject to any disclaimer, the term of this patent is extended or adjusted under 35 U.S.C. 154(b) by 94 days.

(21) Appl. No.: 09/679,747

(22) Filed: Oct. 5, 2000

(30) Foreign Application Priority Data

Oct. 8, 1999 (JP) ..... 11-287988

(51) Int. Cl.[7] ..... B41N 1/24
(52) U.S. Cl. ..... 101/128.21; 428/195
(58) Field of Search ..... 101/128.21, 128.4; 428/195; 503/200

(56) References Cited

U.S. PATENT DOCUMENTS 4,961,377 A * 10/1990 Bando et al. ..... 101/128.21
4,981,746 A * 1/1991 Matsuo et al. ..... 156/60
5,198,407 A * 3/1993 Motegi et al. ..... 427/152
5,270,099 A * 12/1993 Kamiyama et al. ..... 428/195
5,707,712 A * 1/1998 Fujimura et al. ..... 427/256
5,843,560 A 12/1998 Ohta et al.
5,992,315 A * 11/1999 Lorenz ..... 101/128.1
6,000,331 A * 12/1999 Ota ..... 101/128.21
6,050,183 A * 4/2000 Tanaka et al. ..... 101/128.21

FOREIGN PATENT DOCUMENTS

| | | |
|---|---|---|
| EP | 0770500 A2 | 5/1997 |
| GB | 2327129 | 1/1999 |
| GB | 2345912 | 7/2000 |
| JP | 54033117 | 3/1979 |

OTHER PUBLICATIONS

Aug. 22, 2003 Chinese–language official action and English-language translation thereof in connection with corresponding Chinese Patent Appl. No. 00135513.9.

* cited by examiner

*Primary Examiner*—Ren Yan
(74) *Attorney, Agent, or Firm*—Cooper & Dunham LLP

(57) ABSTRACT

A heat-sensitive stencil including a resin film on which a thin resin layer and a porous resin layer are formed in succession.

12 Claims, 1 Drawing Sheet

HEAT-SENSITIVE STENCIL, PROCESS OF FABRICATING SAME AND PRINTER USING SAME

BACKGROUND OF THE INVENTION

This invention relates to a heat-sensitive stencil, to a process of fabricating same and to a printer using same.

One known heat-sensitive stencil is composed of an ink-permeable thin paper serving as an ink support and a thermoplastic resin film bonded with an adhesive to the support. The stencil is heated imagewise by, for example, a thermal head to perforate the heated portions of the thermoplastic resin film, thereby obtaining a printing master for reproducing images by mimeographic printing. The conventional stencil, however, poses problems because (1) the adhesive tends to be accumulated in interstices between fibers to form "fins" which prevent the thermal perforation during the master forming step and the passage of an ink during the printing step, (2) the fibers per se prevent smooth passage of an ink and (3) the paper support is relatively expensive.

To cope with the above problems, JP-A-54-33117 proposes a stencil having no paper support and composed substantially only of a thermoplastic resin film. While this stencil can completely solve the above-mentioned problems, a new serious problem arises; i.e. it is necessary to significantly increase the thickness of the stencil in order to obtain satisfactory stiffness required for transferring the stencil master during printing stage. An increase of the thickness results in the lowering of the thermal sensitivity.

U.S. Pat. No. 5,843,560 discloses a heat-sensitive stencil having a porous resin layer formed on a thermoplastic resin film. The stencil is produced by applying, on a surface of the thermoplastic resin film, a coating liquid containing a resin dissolved in a mixed solvent of a good solvent capable of dissolving the resin and a poor solvent substantially incapable of dissolving the resin and having a lower evaporation rate than the first solvent. The applied coating liquid is then heated to dryness. During the course of the evaporation of the solvents, pores are formed. This stencil has been found to be able to solve the above-described problems but to because a new problem that the porous resin layer is separated from the thermoplastic resin film. For example, when a printing master obtained from the stencil is removed from the plate cylinder after having been used for producing a large number of prints, only the thermoplastic resin film tends to be removed therefrom with the porous resin layer remaining thereon. Additionally, the known stencil fails to exhibit sufficiently high stiffness in humid conditions so that the transferability thereof in the printer is not fully satisfactory.

SUMMARY OF THE INVENTION

It is an object of the present invention to provide a heat-sensitive stencil which has a resin film and a provided thereon and in which the porous resin layer is tightly bonded to the resin film.

Another object of the present invention is to provide a heat-sensitive stencil of the above-mentioned type which has high sensitivity to thermal perforation and which has satisfactory stiffness.

In accomplishing the foregoing objects, there is provided in accordance with one aspect of the present invention a heat-sensitive stencil which includes a porous resin layer, and a resin film laminated on a porous resin layer, and a thin resin layer interposed between the porous resin layer and the resin film.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

A heat-sensitive stencil according to the present invention has a resin film on which a thin resin layer and a porous resin layer are provided in succession in this order.

The thin resin layer is substantially non-porous and is in contact with the resin film substantially throughout its whole area. During perforation of the resin film, the thin resin layer is also perforated together. Thus, the porous resin layer is tightly bonded to the resin film through the thin resin layer. Yet, the stencil has high sensitivity to thermal perforation.

In one, first preferred embodiment, the thin resin layer forms a continuous integral body together with the porous resin layer so that there is no interface between the thin resin layer and the porous resin layer. Since the thin resin layer is bonded with the resin film in its whole area and is integrated with the porous resin layer, fully satisfactory adhesion between the porous resin layer and the resin film can be established. The porous resin layer in this embodiment may be regarded as being a single layer having a base portion (providing the thin resin layer) which is in contact with the resin film and which is substantially non-porous and an upper portion having a multiplicity of open pores or cells. Such a continuous layer structure may be obtained by one stage method as described hereinafter.

Figure 1:
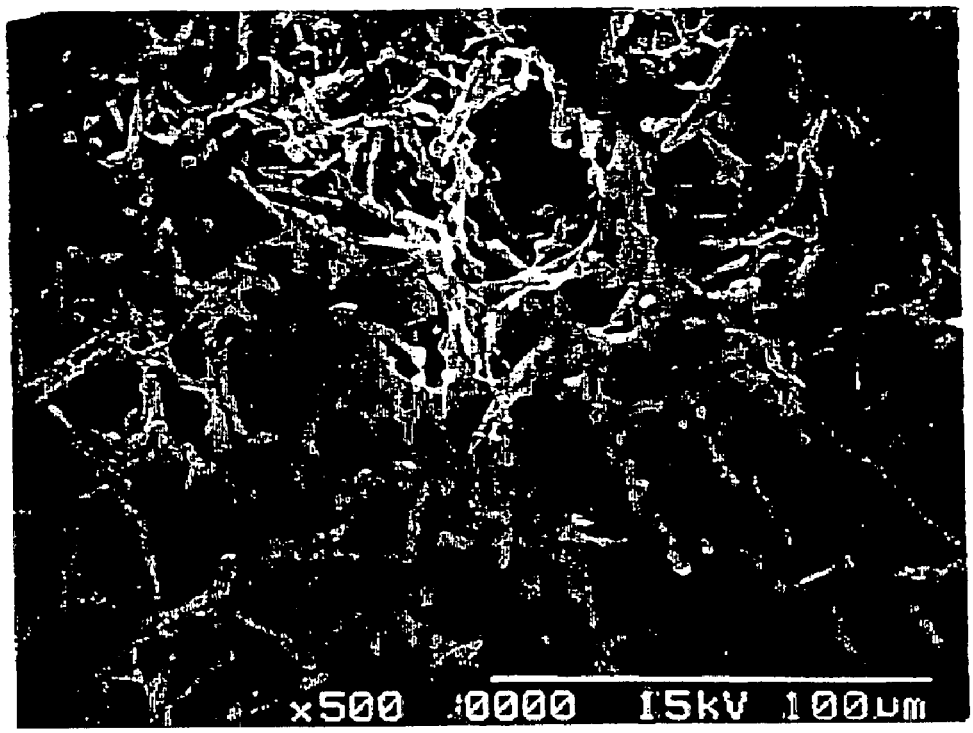
FIG. 1 is a SEM of a surface of a porous resin layer of a heat-sensitive stencil according to the present invention.
Figure 2:
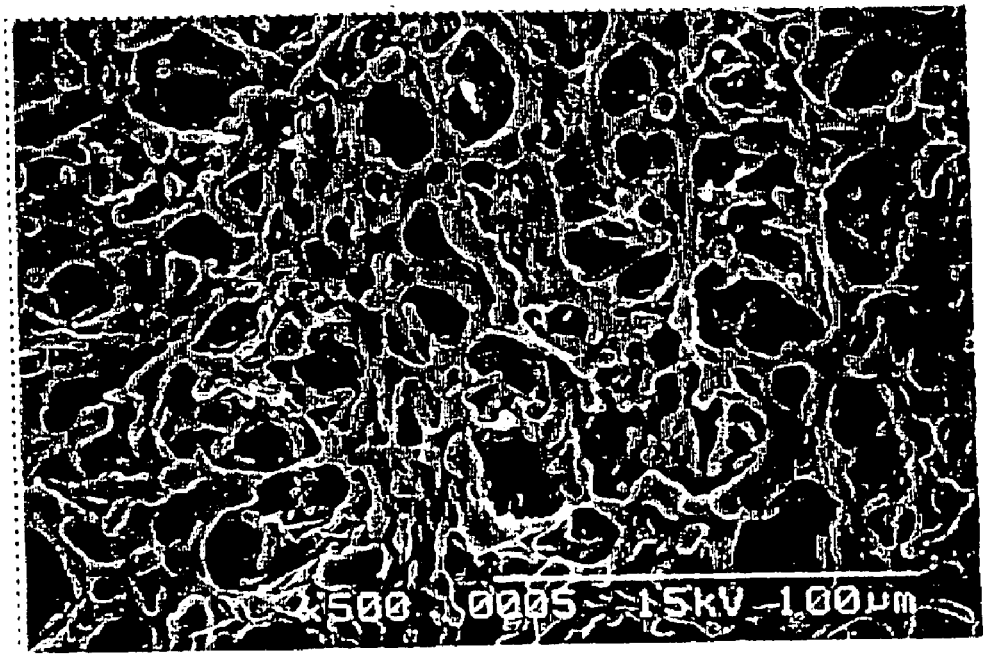
FIG. 2 is a SEM of a surface of a thin resin layer exposed after the removal of a resin film of the heat-sensitive stencil according to the present invention.

FIG. 1 is a SEM (scanning electron micrograph) of a surface of the thin resin layer exposed upon removal of the resin film from the stencil of the above-described first embodiment. The a pin hole has been intentionally pierced through the thin resin layer. A multiplicity of open pores of the porous resin layer can see through the thin resin layer as well as through the pin hole. A SEM of a surface of the porous resin layer of the stencil is shown in FIG. 2.

In another, second embodiment, the thin resin layer and the porous resin layer are separately formed.

In either embodiment, it is necessary that the thin resin layer should be perforated when the resin film is thermally perforated with, for example, a thermal head. Sensitivity to thermal perforation of the thin resin layer may be controlled by selection of the kind of the resin for the thin resin layer and the thickness thereof. It is preferred that the thickness of the thin resin layer be in the range of 1–100% of the thickness of the resin film for reasons of the sensitivity to thermal perforation and stiffness of the stencil. More preferably, the thickness of the thin resin layer is in the range of 0.001 $\mu$m to 10 $\mu$m.

Any resin may be used for the formation of the porous resin layer and the thin resin layer. Illustrative of suitable resins are a vinyl resin such as poly(vinyl acetate), poly (vinyl butyral), poly(vinyl acetal), vinyl chloride-vinyl acetate copolymer, vinyl chloride-vinylidene chloride copolymer, vinyl chloride-acrylonitrile copolymer, or styrene-acrylonitrile copolymer; a polyamide such as nylon; polybutylene; polyphenylene oxide; poly(meth)acrylic ester; polycarbonate; a cellulose derivative such as acetylcellulose, acetylbutylcellulose or acetylpropylcellulose; a polyurethane resin; or a polyester resin. These resins may be used singly or in combination of two or more. For reasons of improved bonding between the porous resin layer and the thin resin layer, it is preferred that the thin resin layer contain at least one resin which is used in the porous resin layer.

The porous resin layer may contain one or more additives such as a filler, an antistatic agent, a stick-preventing agent, a surfactant, an antiseptic agent and an antifoaming agent. Addition of a filler including pigments, particles, powder and fibers to the porous resin layer is desirable to control the strength, stiffness and the size of pores thereof. Use of a filler in the form of needles, fibers or plates is particularly preferred. Illustrative of suitable fillers are needle-like natural mineral fillers such as magnesium silicate, sepiolite, potassium titanate, wollastonite, zonolite and gypsum fiber; needle-like synthetic mineral fillers such as non-oxide-type needle whiskers, oxide whiskers and mixed oxide whiskers; platy fillers such as mica, glass flakes and talc; natural or synthetic fibers such as carbon fiber, polyester fiber, glass fiber, vinylon fiber, nylon fiber and acrylic fiber; and pigments such as organic polymer particles of, for example, poly(vinyl chloride) particles, poly(vinyl acetate) particles and polymethyl acrylate particles, and inorganic particles of, for example, carbon black, zinc oxide, titania, calcium carbonate and silica and microcapsules. The filler is generally used in an amount of 5–200% based on the weight of the resin of the porous resin layer and the thin resin layer.

The resin film may be made of any conventionally employed resin which can be thermally perforated. For reasons of bonding between the resin film and the thin resin layer, it is preferred that the resin film contains at least one resin which is used in the thin resin layer.

A thermoplastic resin is suitably used as the resin film. For reasons of sensitivity to thermal perforation, it is also preferred that the thermoplastic resin have a degree of crystallinity of not higher than 15%. The use of a substantially amorphous thermoplastic resin is particularly preferred.

Illustrative of suitable resins for use in the resin film are poly(vinyl chloride), vinyl chloride-vinylidene chloride copolymer, polyolefin, polycarbonate, ethylene-vinyl alcohol copolymer, polyamide, polystyrene, acrylic polymer and polyester. These resins may be used singly or in combination of two or more. Particularly preferred is the use of a polyester or a polyamide. The polyester is preferably composed of two or more different polycarboxylic acids and/or two or more different polyhydric alcohols to reduce a degree of crystallinity thereof. As a polyamide, nylon copolymer having two or more different homo-nylons is preferably used.

The thickness of the resin film is suitably determined with the consideration of easiness in handling during preparation of the stencil and desirable heat sensitivity during the perforation with a thermal head and is generally 0.5–10 $\mu$m, preferably 1.0–7.0 $\mu$m. It is also preferred that the resin film be biaxially oriented.

The resin film may contain one or more additives such as a flame retardant, a heat stabilizing agent, anti-oxidation agent, a UV absorbing agent, a pigment, a dye, an organic lubricant, an anti-foaming agent and a slippage improving agent, if desired. The lubricant may be a fatty acid ester or a wax. The slippage improving agent may be inorganic particles, such as clay, mica, titanium oxide, calcium carbonate, kaolin, talc or wet or dry silica, or organic particles, such as particles of polymers having acrylic acid or styrene units.

The adhesion between the thin resin layer and the resin film is preferably such as to provide an adhesion strength therebetween of at least 1.0 kg/cm$^2$, more preferably at least 2.0 kg/cm$^2$. The adhesion strength herein is measured as follows. A stencil is cut into a square sample of a 10 mm×10 mm size. The sample is fixed on a horizontal table using a pressure sensitive adhesive double coated tape (NITTO both sides adhesive manufactured by Nitto Tape Inc.; width 5 mm) such that the resin film of the sample faces the table. Using similar double coated adhesive tape, the top surface of the porous resin layer of the sample fixed on the table is attached to a plastic plate secured to a spring balance. The spring balance is then vertically pulled so that the porous resin layer is separated from the resin film. The force required for the separation is measured by the spring balance and represents the adhesion strength.

A total thickness of the porous resin layer and the thin resin layer is preferably 5–100 $\mu$m, more preferably. 6–50 $\mu$m, for reasons of satisfactory ink retentivity in the stencil and ink transferability through the stencil. The thickness can be measured from SEM of a cross-section of the stencil. The basis weight of a total of the porous resin layer and the thin resin layer is preferably 0.5–25 g/m$^2$, more preferably 2–15 g/m $^2$, 3–10 g/m$^2$.

It is preferred that the stencil of the present invention have a flexural rigidity of at least 10 mN, more preferably 15–55 mN, for reasons of transferability in the printing machine. The flexural rigidity may be measured with Rolentzen Stiffness Tester and may be controlled by the thickness and density of the porous resin layer and the amount and kind of the filler.

If desired, a stick preventing layer (overcoat layer) may be provided on a surface of the resin film for the purpose of preventing sticking between a thermal head and the stencil, so that the thermal head can smoothly run or slide on the stencil during perforation for producing a printing master from the stencil. The stick preventing layer may be a layer containing a silicone releasing agent, a fluorocarbon releasing agent or a phosphate surfactant.

The stencil of the present invention may be prepared as follows.

In one process, a resin for forming the porous resin layer is first dissolved in a mixed solvent including a first solvent (good solvent) capable of dissolving the resin and a second solvent (poor solvent) substantially incapable of dissolving the resin, thereby to obtain a coating liquid. Preferably the first solvent has a boiling point which is lower by 15–40° C. than that of the second solvent. Examples of the good and poor solvents for resins are described in U.S. Pat. No. 5,843,560, the whole disclosure of which is hereby incorporated by reference herein.

The concentration of the resin in the mixed solvent solution is generally 2–50% by weight. The weight ratio of the first solvent to the second solvent is preferably in the range of 13:1 to 20:1.

The thus obtained coating liquid is then applied over a surface of a resin film to form a wet resin coating. The application of the coating liquid may be carried out by any desired coating method such as blade coating, transfer roll coating, wire bar coating, die coating, reverse roll coating or gravure coating. The wet resin coating is then heated at a temperature below the boiling point of the second solvent but sufficient to vaporize part of the first solvent. Subsequently, the coating is further heated preferably at 80° C. or less until the coating is completely dried. During the course of the vaporization of the solvents, there are simultaneously formed a thin resin layer at a region adjacent to the resin film and a porous resin layer having a multiplicity of open pores on the thin resin layer.

While not wishing to be bound by the theory, it is believed that the porous resin layer and thin non-porous resin layer are formed by the following mechanism. As the good solvent in a surface region of the wet coating evaporates, the concentration of the poor solvent increases. Thus, resin begins precipitating on nuclei. The precipitates combine and grow to form a three-dimensional matrix. Since, in a region adjacent to the resin film, the good solvent does not evaporate quickly but remains, the resin does not precipitate. As a result, when the good solvent is forced to evaporate, there is formed a substantially non-porous thin resin layer on the resin film.

In another process, a coating solution containing a resin for the thin resin layer is applied to a surface of the resin film and dried to form the thin resin layer. Next, a porous resin layer is formed-on the thin resin layer by a method disclosed in U.S. Pat. No. 5,843,560. Thus, for example, a coating liquid containing a resin for forming the porous resin layer dissolved in a mixed solvent including a good solvent capable of dissolving the resin and a poor solvent substantially incapable of dissolving the resin is applied on the thin resin layer and dried to form the porous resin layer.

In a further process, a thin resin layer and a porous resin layer are simultaneously formed on a releasable surface, such as a fluorocarbon sheet, in a manner similar to the above-described process. The thus obtained material consisting of the thin resin layer and the porous resin layer is peeled and separated from the releasable surface. By bonding a resin film to the material, a stencil of the present invention can be obtained.

It is preferred that the heat-sensitive stencil of the present invention provide air permeability of 2.0 $cm^3/cm^2 \cdot sec$ to 160 $cm^3/cm^2 \cdot sec$, when perforated to have an open ratio of at least 20%.

The air permeability may be measured in the following manner. A square solid pattern (black pattern) with a size of 10×10 cm is read by a printer (PRIPORT VT 3820 manufactured by Ricoh Company, Ltd.) and a sample stencil is perforated with a thermal head in accordance with the read out pattern to form a printing master. The perforation operations are performed for five similar samples with different thermal energy so that three printing masters having open ratios $S_O/S_p$ of about 20%, 50% and 80% are obtained ($S_O$ represents a total area of the perforations and $S_p$ represents the area of the pattern). The open ratio of a master may be measured by making a photomicrograph (magnification: 100) thereof. The photomicrograph is then magnification-copied (magnifying ratio: 200) using a copying machine (IMAGIO MF530 manufactured by Ricoh Company, Ltd.). Perforations shown in the copy are marked on an OHP film and then read by a scanner (300 DPI, 256 gradient). This is binarized with an image retouch software Adobe Photoshop 2.5J. The open ratio of the perforations is measured using an image analysis software NIH IMAGE. The perforated portion of each of the printing masters is measured for the air permeability thereof using a permeameter (manufactured by Toyo Seiki Seisakusho Inc.) in the conventional manner. When at least one of the three masters has an air permeability in the range of 2.0 $cm^3/cm^2 \cdot sec$ to 160 $cm^3/cm^2 \cdot sec$, the stencil is regarded as being preferred.

If desired, a porous support, such as a natural and/or synthetic paper or a woven or non-woven fabric, may be provided on the porous resin layer to improve the stiffness of the stencil. The natural fibers may be, for example, kozo (*Broussonetia kazinoki*), mitsumata (*Edgeworthia papyrifera*), Manila hemp. The synthetic fibers may be, for example, polyester fibers, vinylon fibers. A mixture of a natural fiber with a synthetic fiber may be suitably used for a porous thin paper support. The thin paper support preferably has, as measured in accordance with the Japanese Industrial Standard) a basis weight of 1–12 $g/m^2$, a density of 0.1–0.8 g/ml and an air permeability of 0.5–12 second/96 sheets.

The porous support may be bonded to the porous resin layer with an adhesive. Thus, the porous support is applied with the adhesive by multi-roll coating or reverse roll coating and bonded to the porous resin layer.

The adhesive may be, for example, an urethane resin, a prepolymer of a diisocyanate and a polyether, a mixture of an active hydrogen-containing resin with a polyisocyanate, or an adhesive hardenable by irradiation with UV or electron beams and is generally used in an amount of 0.03–5.0 $g/m^2$, preferably 0.05–1.5 $g/m^2$.

The heat-sensitive stencil of the present invention is generally in the form of an elongated sheet wound around a cylindrical plastic or paper core having a length of, for example, 100–330 mm and a diameter of, for example, 0.5–6 inches. In use, the stencil is unwound and cut into a suitable length. Perforation of the stencil may be performed by any known method using, for example, infrared rays, a thermal head operated by digital electric signals or a laser beam.

The following examples will further illustrate the present invention. Parts and percentages are by weight.

EXAMPLE 1

In 33.6 parts of methanol, 4 parts of poly(vinyl butyral) (PVB4000-1 manufactured by Denki Kagaku Kogyo K. K.) were dissolved, to which 2.2 parts of water were slowly added with stirring to obtain a slightly cloudy coating liquid. The coating liquid was uniformly applied to a biaxially stretched polyester film (thickness: 2.0 $\mu$m) with a wire bar at a temperature of 20° C. and a relative humidity of 50%, thereby to form a wet coating having a deposition amount of 7.0 $g/cm^2$ (on dry basis). This was placed in a drying chamber at 50° C. for 3 minute to dry the coating and to obtain a laminate having a thin, non-porous poly(vinyl butyral) layer and a porous poly(vinyl butyral) layer continuously formed on the polyester film.

The porous poly(vinyl butyral) layer was peeled from the polyester film using an adhesive tape. SEM of an exposed surface of the porous layer revealed the presence of the thin, non-porous poly(vinyl butyral) layer located in the interface between the polyester film and the porous poly(vinyl butyral) layer. The formation of the thin, non-porous resin layer was also confirmed by the following test. The removed porous layer was placed on a paper and an ink was applied on the porous layer. It was found that the ink was prevented from arriving at the paper. SEM of a cut surface of the laminate revealed that the thin poly(vinyl butyral) layer had a thickness of about 0.4 $\mu$m.

A liquid containing a silicone resin and a cationic antistatic agent (DSK Erenon No. 19M manufactured by Daiichi Kogyo Seiyaku Co., Ltd.) was applied on the back side of the polyester film opposite the porous layer and dried to obtain a heat-sensitive stencil according to the present invention having a stick preventing layer (overcoat layer) with a deposition amount of 0.05/m$^2$.

EXAMPLE 2

In 33.6 parts of methanol, 4 parts of poly(vinyl butyral) (PVB4000-1 manufactured by Denki Kagaku Kogyo K. K.) and 0.8 part of whiskers of potassium titanate (TOFIKA Y manufactured by Ootsuka Chemical Inc.) were mixed using a ball mill, to which 2.3 parts of water were slowly added with stirring to obtain a slightly cloudy coating liquid. Using this coating liquid, the procedures of Example 1 were repeated in the same manner as described to obtain a heat-sensitive stencil having a stick preventing layer. A thin, non-porous poly(vinyl butyral) layer having a thickness of about 0.4 $\mu$m was found to be formed.

EXAMPLE 3

A coating liquid containing 2.5%, in terms of solid content, of a polyisocyanate (CORONATE L manufactured by Nippon Polyurethane Inc.) and 2.5%, in terms of solid content, of a vinyl acetate resin (BYRON 50S manufactured by Toyobo Inc.) was uniformly applied to a biaxially stretched polyester film (thickness: 2.0 $\mu$m) and dried to form a thin, non-porous resin layer having a deposition amount of 0.01 g/cm$^2$ (on dry basis) and a thickness of about 0.3 $\mu$m.

In 33.6 parts of methanol, 4 parts of poly(vinyl butyral) (PVB4000-1 manufactured by Denki Kagaku Kogyo K. K.) were dissolved, to which 2.8 parts of water were slowly added with stirring to obtain a slightly cloudy coating liquid. The coating liquid was uniformly applied to a surface of the above thin resin layer with a wire bar at a temperature of 20° C. and a relative humidity of 50%, thereby to form a wet coating having a deposition amount of 7.0 g/cm$^2$ (on dry basis). This was placed in a drying chamber at 50° C. for 3 minute to dry the coating and to obtain a laminate having a porous poly(vinyl butyral) layer formed on the thin resin layer on the polyester film.

A liquid containing a silicone resin and a cationic antistatic agent was applied on the back side of the polyester film opposite the porous layer and dried to obtain a heat-sensitive stencil according to the present invention having a stick preventing layer (overcoat layer) with a deposition amount of 0.05/m$^2$.

EXAMPLE 4

In 33.6 parts of methanol, 4 parts of poly(vinyl butyral) (PVB4000-1 manufactured by Denki Kagaku Kogyo K. K.) and 0.8 part of whiskers of potassium titanate (TOFIKA Y manufactured by Ootsuka Chemical Inc.) were mixed using a ball mill, to which 2.3 parts of water were slowly added with stirring to obtain a slightly cloudy coating liquid. This coating liquid was applied to a polyester film in the same manner as that in Example 1 to obtain a laminate having a thin, non-porous poly(vinyl butyral) layer with a thickness of about 0.5 $\mu$m and a porous poly(vinyl butyral) layer formed thereon.

On the thus formed porous poly(vinyl butyral) layer, a porous support made of a polyester fiber and having a basis weight of 7.5 g/m$^2$ was bonded with an urethane emulsion adhesive (5% aqueous solution). Further, a stick preventing layer was formed on the polyester film in the same manner as that in Example 1 to obtain a heat-sensitive stencil of the present invention.

COMPARATIVE EXAMPLE 1

Example 1 was performed in the same manner as described except that the amount of water was increased from 2.2 parts to 2.8 parts to obtain a heat-sensitive stencil. A non-porous poly(vinyl butyral) layer was not detected by SEM and ink test.

Each of the thus obtained heat-sensitive stencils was measured for open ratio, air permeability, bonding strength, flexural rigidity, perforation sensitivity, print density, print image quality and offset. The open ratio, air permeability, bonding strength and flexural rigidity were measured by the methods described previously.

The other properties were measured using perforation sensitivity was measured using PRIPORT VT 3820 (manufactured by Ricoh Company Ltd.; provided with a thermal head manufactured by Toshiba Inc.).

The perforation sensitivity was evaluated according to the following ratings:

A: all perforations are properly formed

B: part of perforations have small diameters

C: not all perforations are formed

The print density of the 20th print from the initiation of printing was measured using McBeath densitometer.

The print image quality was evaluated with respect to blurs and variation of density. Offset is an undesirable phenomenon of transference of an ink in a stacked prints from one print to adjacent print. Evaluation was made by comparison with the image obtained using a commercial stencil (VT2 Master manufactured by Ricoh Company Ltd.) and rated as follows:

A: much better

B: slightly better

C: comparable

It was found that each of the stencils of Examples 1–4 and Comparative Example 1 gave rank A perforation sensitivity, rank A image quality and rank A offset. The results of the tests for the other properties are shown in Table 1.

TABLE 1

| Example | Open ratio (%) | Air Permeability (cm$^3$/cm$^2$ · sec) | Bonding Strength (kg/cm$^2$) | Flexural Rigidity (mN) | Print Density |
|---|---|---|---|---|---|
| 1 | 20 | 15 | 2.2 | 27 | 1.06 |
| | 49 | 31 | | | |
| | 82 | 48 | | | |
| 2 | 19 | 17 | 2.0 | 35 | 1.09 |
| | 48 | 36 | | | |
| | 77 | 53 | | | |
| 3 | 21 | 14 | 2.6 | 26 | 1.02 |
| | 47 | 30 | | | |
| | 80 | 46 | | | |
| 4 | 20 | 15 | 2.1 | 45 | 1.00 |
| | 48 | 30 | | | |
| | 79 | 45 | | | |
| Comp. Ex. 1 | 21 | 14 | 1.3 | 14 | 1.12 |
| | 50 | 33 | | | |
| | 80 | 49 | | | |

After 200 sheets of prints had been produced, the stencil on the plate cylinder was intentionally torn and the remaining portion of the stencil was removed manually therefrom.

In the case of the stencils of Examples 1–4, the stencils were removed from the plate cylinder. In the case of the stencil of Comparative Example 1, the polyester film was separated from the porous resin layer so that the porous resin layer remained unremoved from the plate cylinder.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. H11-287988, filed Oct. 8, 1999, inclusive of the specification, claims and drawings, are hereby incorporated by reference herein.

What is claimed is:

1. A method of preparing a heat-sensitive stencil comprising a porous resin layer, and a resin film laminated on said porous resin layer, and a thin resin layer interposed between said porous resin layer and said resin film, said method comprising the steps of:

applying a wet coating composition to a surface of said resin film, said wet composition containing a resin, a first solvent capable of dissolving said resin, and a second solvent substantially incapable of dissolving said resin;

applying heat to said composition at a temperature below a boiling point of said second solvent and sufficient to vaporize at least part of said first solvent; and drying said applied composition by applying heat to said composition at a temperature sufficient to completely vaporize said first solvent and said second solvent to form said thin resin layer and said porous layer simultaneously as a continuous unitary body on said surface of said film.

2. A method as set forth in claim 1, wherein the weight ratio of said first solvent to said second solvent is greater than 1:1.

3. The method as set forth in claim 1, further comprising forming a non-resinous porous layer on the porous resin layer.

4. The method as set forth in claim 1, wherein the heat-sensitive stencil has a flexural rigidity of at least 10 mN.

5. The method as set forth in claim 1, wherein an adhesion strength between the thin resin layer and the resin film is at least 1.0 kg/cm$^2$.

6. The method as set forth in claim 1, wherein a thickness of the thin resin layer is in a range of 0.001 $\mu$m to 10 $\mu$m.

7. The method as set forth in claim 1, wherein the resin film has at least one resin component which is the same as that of the thin resin layer.

8. The method as set forth in claim 1, wherein the thin resin layer has at least one resin component which is the same as that of the porous resin layer.

9. The method as set forth in claim 1, further comprising winding the heat-sensitive stencil around a cylindrical core.

10. A method of preparing a heat-sensitive stencil comprising a porous resin layer, and a resin film laminated on said porous resin layer, and a thin resin layer interposed between said porous resin layer and said resin film, said method comprising the steps of:

applying a first coating composition to a surface of said resin film, drying said applied first composition to form said thin resin layer on said surface of said film, applying a second coating composition to a surface of said thin resin layer, and drying said applied second composition to form said porous resin layer on said surface of said thin resin layer.

11. The method as set forth in claim 10, wherein the thin layer has no resin component which is common to that of the porous resin layer.

12. A method of preparing a heat-sensitive stencil comprising a porous resin layer, and a resin film laminated on the porous resin layer, and a thin resin layer interposed between the porous resin layer and the resin film, the method comprising:

applying a wet coating composition to a releasable surface, the wet composition containing a resin, a first solvent capable of dissolving the resin, and a second solvent substantially incapable of dissolving the resin;

drying the applied composition to form the thin resin layer and the porous resin layer simultaneously as a continuous unitary body on the releasable surface;

separating the unitary body formed by the thin resin layer and the porous resin layer from the releasable surface; and bonding the resin film to the thin resin layer of the unitary body.

* * * * *

UNITED STATES PATENT AND TRADEMARK OFFICE

CERTIFICATE OF CORRECTION

PATENT NO. : 6,889,605 B1
DATED : May 10, 2005
INVENTOR(S) : Yuji Natori

It is certified that error appears in the above-identified patent and that said Letters Patent is hereby corrected as shown below:

Title page,
Item [73] should read:
-- [73] Assignees: Ricoh Company, Ltd., Tokyo (JP);
Tohoku Ricoh Co., Ltd., Miyagi-ken (JP). --.

Signed and Sealed this

Thirteenth Day of December, 2005

JON W. DUDAS
*Director of the United States Patent and Trademark Office*